US006131826A

United States Patent [19]

Teiwes

[11] Patent Number: 6,131,826

[45] Date of Patent: Oct. 17, 2000

[54] VALVE WITH COMBINED VALVE SEAT BODY AND PERFORATED INJECTION DISK

[75] Inventor: Henning Teiwes, Hallstadt, Germany

[73] Assignee: Robert Bosch GmbH, Stuttgart, Germany

[21] Appl. No.: 09/331,351

[22] PCT Filed: Oct. 18, 1997

[86] PCT No.: PCT/DE97/02403

§ 371 Date: Jun. 17, 1999

§ 102(e) Date: Jun. 17, 1999

[87] PCT Pub. No.: WO98/28538

PCT Pub. Date: Jul. 2, 1998

[30] Foreign Application Priority Data

Dec. 21, 1996 [DE] Germany ..... 196 53 832

[51] Int. Cl.[7] ..... B05B 1/30; F02M 61/10

[52] U.S. Cl. ..... 239/533.11; 239/533.13; 239/533.14; 239/900; 239/585.1; 137/901; 251/118

[58] Field of Search ..... 239/533.6, 533.11, 239/533.12, 533.13, 533.14, 533.15, 585.1, 596, 900; 137/901; 251/118, 333, 334

[56] References Cited

U.S. PATENT DOCUMENTS

| | | | |
|---|---|---|---|
| 3,224,684 | 12/1965 | Roosa | 239/533.11 |
| 3,958,757 | 5/1976 | Happel et al. | 239/533.14 X |
| 4,482,129 | 11/1984 | Baker et al. . | |
| 4,897,907 | 2/1990 | Kopiec et al. . | |
| 5,002,231 | 3/1991 | Reiter et al. . | |
| 5,239,751 | 8/1993 | Kanamaru et al. . | |
| 5,340,032 | 8/1994 | Stegmaier et al. | 239/585.1 X |
| 5,718,387 | 2/1998 | Awarzamani et al. | 239/585.1 |

FOREIGN PATENT DOCUMENTS

| | | |
|---|---|---|
| 42 21 185 | 1/1994 | Germany . |
| 7-063140 | 3/1995 | Japan . |

*Primary Examiner*—Andres Kashnikow
*Assistant Examiner*—Robin O. Evans
*Attorney, Agent, or Firm*—Kenyon & Kenyon

[57] ABSTRACT

A valve, in particular a fuel injection valve for fuel injection systems of internal combustion engines is described. The valve has a valve seat surface formed on a valve seat body, which interacts with an actuatable valve closing body to form a sealing seat, as well as a perforated disk, which has at least one spray hole. The valve seat body and the perforated disk are designed as one piece from a flat, deformable workpiece. The workpiece is pot shaped so that in the area of the valve seat surface it is in sealing contact with the non-actuated valve closing body when the valve is closed and forms the perforated disk having at least one spray hole in an area downstream from the valve seat surface.

15 Claims, 1 Drawing Sheet

VALVE WITH COMBINED VALVE SEAT BODY AND PERFORATED INJECTION DISK

FIELD OF THE INVENTION

The present invention is based on a valve, in particular a fuel injection valve for fuel injection systems in internal combustion engines.

BACKGROUND INFORMATION

German Patent Application No. 42 21 185 describes a fuel injection valve in which the valve seat body is manufactured using a cutting process. The valve seat body must be subjected to a fine machining operation after the preliminary cutting operation in order to achieve the accuracy that is required for the sealing function in interacting with a spherical valve closing body. A perforated disk manufactured separately is sealingly attached to the valve seat body by welding. Welding has the disadvantage that the heat effect may result in undesirable deformation. The conventional two-part combination of the valve seat body and perforated disk entails high labor costs both in manufacturing the valve seat body and the perforated disk and in mounting these parts on a valve seat carrier of the fuel injection valve. The relatively high processing cost and the relatively high material costs together result in a relatively high manufacturing cost.

SUMMARY OF THE INVENTION

The valve according to the present invention has the advantage over the related art that the valve seat body and the perforated disk are integrated on a single connecting piece, and this connecting piece can be manufactured from a flat, deformable workpiece, e.g., a metal sheet part, by deep drawing in a simple and material-saving manner. This results in significant cost savings, in particular, in mass production. The one-piece design of the valve seat body and the perforated disk made from a single metal sheet results not only in easier machinability and lower weight of the valve seat body/perforated disk combination, but also in lower metal consumption. The sealing characteristics are also improved.

Providing a preferably polyhedron-shaped guide section upstream from the valve seat surface so that the valve closing body is axially guided in its opening and closing motion has proven advantageous. Unrestricted flow of the medium through the valve up to the sealing valve seat surface is allowed by the polyhedron-shaped design of the guide section.

It is also advantageous if the flat, deformable workpiece, from which the valve seat surface and the perforated disk are made, is bent downstream from the guide section, so that an attachment section of the flat, deformable workpiece extends in the direction of a circumferential end of the workpiece in the flow direction. This has the advantage that the circumferential end of the workpiece is easily accessible so it can be attached to the valve seat carrier, for example, by applying a weld. The other advantage is that the workpiece can be displaced in the valve seat carrier using a displacement tool that engages it from the injection side to set the opening lift of the valve without the tool being seized in the valve seat carrier. After attaching the workpiece to the valve seat carrier, the position of the valve seat and thus the valve lift, i.e., the maximum flow allowed by the valve, can still be slightly changed using the displacement tool. In this case, the workpiece suffers a slight plastic deformation only in the areas distant from the seat.

It is advantageous if the displacement tool is adapted to the shape of the workpiece so that the displacement tool only grips the attachment section and/or the bending area of the workpiece to avoid deformation of the valve seat surface or the section forming the perforated disk during the displacement to set the valve lift.

DETAILED DESCRIPTION

Figure 1:
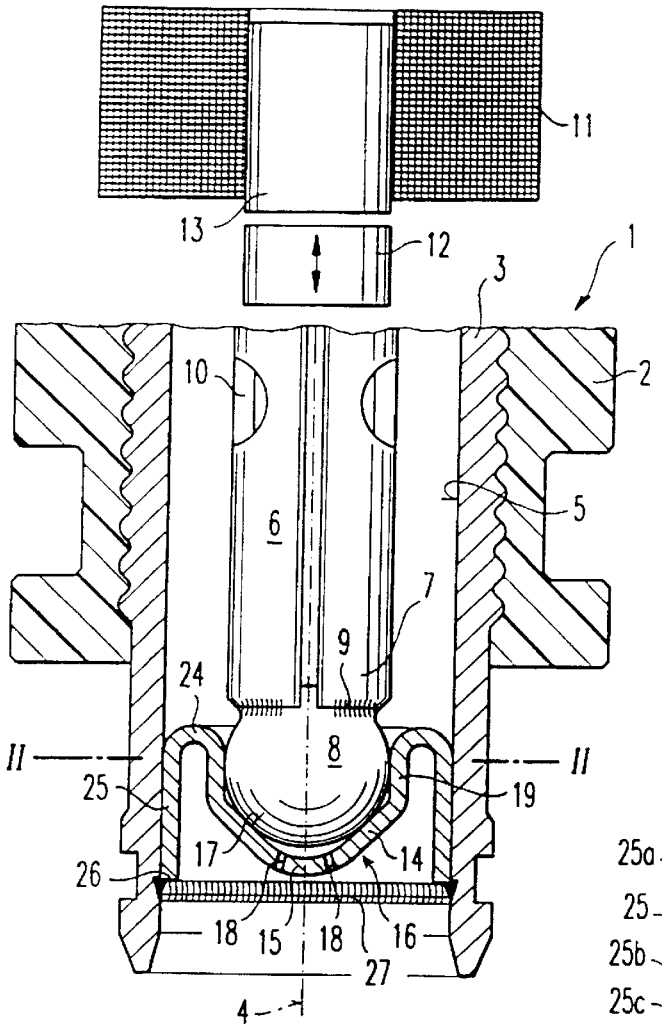
FIG. 1 shows an exemplary embodiment of the present invention using the example of a fuel injection valve shown in a partial sectional view.

FIG. 1 schematically shows as an example a part of a valve in the form of a fuel injection valve for fuel injection systems of compressed-mixture externally ignited internal combustion engines. The present invention, however, can be used not only in fuel injection valves, but also in other similar valves for liquid or gaseous media.

Fuel injection valve 1 has a tubular valve seat carrier 3 partially surrounded by a plastic coating 2. A longitudinal bore 5 is formed in valve seat carrier 3 concentrically with longitudinal valve axis 4. A valve needle 6, which is tubular in the present exemplary embodiment, is arranged in longitudinal bore 5 and, at its downstream end 7, is connected by a weld 9 to a valve closing body 8, which has a spherical shape in the present embodiment. The fuel, entering, for example, through the inside of valve needle 6, can unimpededly enter into longitudinal bore 5 via openings 10 and flow to valve closing body 8.

Fuel injection valve 1 is actuated in the conventional manner, for example, electromagnetically. An electromagnetic circuit (only indicated) with a magnet coil 11, an armature 12 and a core 13, surrounded by magnet coil 11, is used to axially move valve needle 6 and thus to open the valve against the elastic force of a restoring spring (not illustrated). Armature 12 is connected to the end of valve needle 6 facing away from valve closing body 8 and aligned with core 13.

Valve closing body 8 interacts with a valve seat surface 17 formed on a valve seat body 14 to form a sealing seat. Spray holes 18 to spray the medium flowing through the valve, fuel in the present embodiment, are formed on a perforated disk 15. According to the present invention, valve seat body 14 and perforated disk 15 are integrated on a one-piece, flat, deformable workpiece 16. One-piece, flat workpiece 16 is preferably a sheet metal part, which is shaped in a pot-like shape shown in FIG. 1 by deep drawing. Workpiece 16 is conically shaped in the area of valve closing body 14, so that spherical valve closing body 8 sealingly contacts valve seat surface 17 over a circumferential contact line. In order to improve the sealing contact between valve closing body 8 and valve seat surface 17, valve seat surface 17 can be post-machined after the deep drawing of workpiece 16 using an appropriate process, for example, polishing, so that the required shape accuracy is achieved.

The section of workpiece 16 forming perforated disk 15 is located downstream from the section of workpiece 16 forming valve seat body 14. Workpiece 16 is convex in the area of perforated disk 15 in the flow direction, so that the preferably several, for example four, spray holes are inclined outward with respect to longitudinal valve axis 4. Thereby the spray characteristics of fuel injection valve 1 redesigned according to the present invention are further improved. The convex shape of the section of workpiece 15 forming perforated disk 15 also causes workpiece 16 not to contact spherical valve closing body 8 in the area of spray holes 18.

Figure 2:
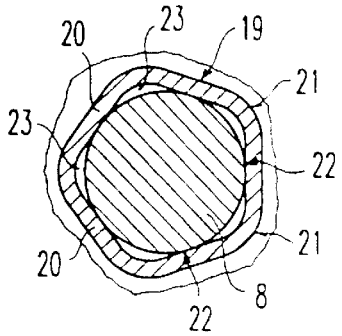
FIG. 2 shows a section along line II—II of FIG. 1.

A guide section 19 is provided upstream from the section of workpiece 16 forming valve seat body 14. To better elucidate the geometry of workpiece 16 in guide section 19, a section along line II—II in FIG. 1 is shown in FIG. 2. Spherical valve closing body 8, embedded in guide section 19 of workpiece 16, can be seen. Workpiece 16 has the form of a polyhedron in guide section 19 and has a plurality of guide surfaces 20, which supplement one another to form a polyhedron with rounded corners 21. The polyhedron may have five comers 21 and five guide surfaces 20, for example. Guide surfaces 20 are in contact with valve closing body 8 at contact points 22 to guide valve closing body 8. Thus flow passages 23 are formed between contact points 22, which allow unimpeded flow of the medium, fuel in this embodiment, through the valve up to valve seat surface 17.

As can be seen in FIG. 1, flat, deformable workpiece 16 is bent, in the embodiment at a 180° angle, in a bend section 24, so that, in the direction of a circumferential end 26 of workpiece 16, a radially outer attachment section 25 adjacent to bend section 24 extends parallel to the direction of flow of the medium passing through fuel injection valve 1. In the embodiment illustrated in FIG. 1, attachment section 25 is in contact, over its entire axial length, with the inner wall of longitudinal bore 5 in valve seat carrier 3 and is form-fittingly and sealingly connected to valve seat carrier 3 at its circumferential end 26, preferably by a weld 27. The sealing connection between workpiece 16 and valve seat carrier 3 ensures that the medium flowing through fuel injection valve 1 does not flow around the sealing seat between valve seat carrier 3 and workpiece 16.

End 26 of workpiece 16 is located downstream from spray holes 18, so that the accessibility of circumferential end 26 for applying weld 27 is guaranteed. The large contact surface between attachment section 26 and valve seat carrier 3 allows the heat generated by welding to be removed from valve seat carrier 3, so that guide section 19, the section of workpiece 16 forming valve seat body 14, and the section of workpiece 16 forming perforated disk 15 are prevented from overheating. This counteracts deformation of these areas during welding of workpiece 16 to valve seat carrier 3.

Spray holes 18 in workpiece 16 may be applied in the known manner by punching, drilling, laser drilling, erosion, or another suitable manufacturing method. Spray holes 18 can be applied either in the unmolded blank of workpiece 16 or at a later time after workpiece 16 has been molded.

Figure 4:
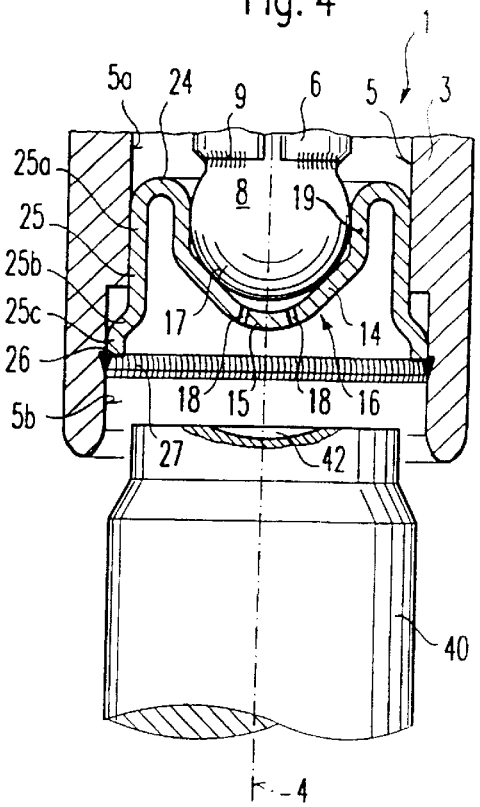
FIG. 4 shows a particular view of a further exemplary embodiment of a valve together with a displacement tool to set the valve lift.
Figure 3:
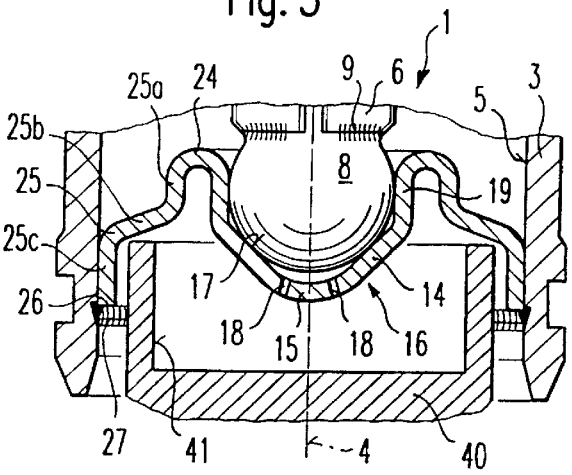
FIG. 3 shows a partial view of another exemplary embodiment of a valve together with a displacement tool to set the valve lift.

FIGS. 3 and 4 show additional exemplary embodiments of a fuel injection valve I only shown partially as a section, with a variation of attachment section 25 and valve seat carrier 3 with respect to the embodiment shown in FIG. 1.

In the embodiment shown in FIG. 3, the diameter of longitudinal bore 5 in valve seat carrier 3 is larger than that shown in FIG. 1. Attachment section 25 of workpiece 16 is divided into three areas: a first axial section 25*a*, adjacent to bend section 24 in the flow direction, a second axial section 25*c* bordering circumferential end 26 and in contact with the inner wall of longitudinal bore 5, and a radial section 25*b*, which connects the first and second axial sections 25*a* and 25*c* to a radial component. Also in this embodiment, circumferential end 26 of workpiece 16 is welded to valve seat body 3 with a sealing circumferential weld 27.

This embodiment has the advantage over the embodiment illustrated in FIG. 1 that the distance between weld 27 and guide section 19, as well as the sections forming valve seat body 14 and perforated disk 15, is lengthened by radial section 25*b*, which counteracts thermal deformation of the aforementioned areas during the application of the weld.

Furthermore, the geometric shape of workpiece 16 illustrated in FIG. 3 has the additional substantial advantage that a displacement tool 40, used to adjust the valve lift of fuel injection valve 1 according to the present invention can grip radial section 25*b* of attachment section 25 unhindered. The depth of insertion of workpiece 16 in longitudinal bore 5 of valve seat carrier 3 determines the presetting of the lift of valve needle 6, since the end position of valve needle 6 when magnet coil 11 is not excited is determined by the contact of valve closing body 8 with valve seat surface 17. The other end position of valve needle 6 when magnet coil 11 is excited is determined, for example, by the contact of armature 12 with core 13. The path between these two end positions of valve needle 6 represents the valve lift.

Displacement tool 40 has a bell shape, so that the areas of workpiece 16 forming valve seat body 14 and perforated disk 15 fit in a bell-shaped recess 41 of displacement tool 40 when displacement tool 40 grips radial section 25*b*. Thus deformation of guide section 19 and the areas forming valve seat body 14 and perforated disk 15 during the axial displacement of workpiece 16 in longitudinal bore 5 of valve seat carrier 3, which serves to set the valve lift, is prevented. The second axial section 25*c* has a slightly greater diameter than the inner diameter of longitudinal bore 5, so that the second axial section 25*c* elastically presses against the inner wall of longitudinal bore 5 and secures workpiece 16 in longitudinal bore 5.

The embodiment illustrated in FIG. 4 differs from that in FIG. 3 by the fact that the first axial section 25*a* of attachment section 25 of workpiece 16 is longer and radial section 25*b* and second axial section 25*c* is shorter. Longitudinal bore 5 of valve seat carrier 3 is designed as a stepped hole at the injection side of valve seat carrier 3 and has a step 5*b*, adjacent to step 5*a* on the injection side with a larger diameter. Second axial section 25*c* is welded to the widened step hole 5*b*, while first axial section 25*a* is in elastic contact with step 5*a* of longitudinal bore 5. This embodiment also provides good heat removal of the heat generated by welding at valve seat carrier 3, so that thermal deformation of guide section 19 and the areas forming valve seat body 14 and perforated disk 15 is prevented.

Displacement tool 40 can grip radial section 25*b* of attachment section 25 of workpiece 16 also in this embodiment; in this case, the area of workpiece 16 forming perforated disk 15 is inserted in a cavity 42 of displacement tool 40 provided for this purpose.

Workpiece 16 can be made of a hard base material or hardened in some or all areas for wear resistance. It is also conceivable to protect workpiece 16 by applying a hard coating, for example, made of TiN, at least in the areas subject to wear.

What is claimed is:

1. A valve, comprising:

an actuatable valve closing body;

a valve seat body;

a valve seat formed on the valve seat body, the valve seat interacting with the valve closing body to form a sealing seat; and a perforated disk having at least one spray hole in a particular area which is downstream from the valve seat, wherein the valve seat body and the perforated disk are configured as one piece, the one piece being formed from a flat deformable workpiece which represents a metal sheet part, the flat deformable workpiece having a pot shape, wherein, when the valve closing body is not actuated and when the valve is in a closed state, the flat deformable workpiece sealingly contacts the valve closing body in a further area of the valve seat and forms the perforated disk, wherein the valve seat body has a valve seat surface in the further area of the valve seat, the flat deformable workpiece forming a guide section which guides the valve closing body when the valve closing body is actuated, the guide section being situated upstream from the valve seat surface, and wherein the flat deformable workpiece upstream from the valve seat surface is shaped to form a guide section to guide the valve closing body when the valve closing body is actuated.

2. The valve according to claim 1, wherein the valve is a fuel injection valve for a fuel injection system of an internal combustion engine.

3. The valve according to claim 1, wherein the flat deformable workpiece is deformed using a deep drawing procedure.

4. The valve according to claim 1, wherein the flat deformable workpiece has a convex shape in an area of the at least one spray hole.

5. The valve according to claim 1, wherein the valve closing body has an at least partially spherical shape, the valve seat surface having a conical shape.

6. The valve according to claim 1, wherein the valve closing body contacts flow passages which are situated on guide surfaces, the flow passages contacting the valve closing body at contact points on the guide section and between the contact points.

7. The valve according to claim 6, wherein the valve closing body has an at least partially spherical shape, the guide section having a polyhedron shape.

8. The valve according to claim 7, wherein the guide section has the polyhedron shape with rounded corners.

9. The valve according to claim 1, wherein the flat deformable workpiece is hardened at least in an area of the valve seat surface.

10. The valve according to claim 9, wherein the flat deformable workpiece is hardened using a hard coating procedure.

11. A valve, comprising:

an actuatable valve closing body;

a valve seat body;

a valve seat formed on the valve seat body, the valve seat interacting with the valve closing body to form a sealing seat; and a perforated disk having at least one spray hole in a particular area which is downstream from the valve seat, wherein the valve seat body and the perforated disk are configured as one piece, the one piece being formed from a flat deformable workpiece which represents a metal sheet part, the flat deformable workpiece having a pot shape, wherein, when the valve closing body is not actuated and when the valve is in a closed state, the flat deformable workpiece sealingly contacts the valve closing body in a further area of the valve seat and forms the perforated disk, and wherein the valve seat body has a valve seat surface in the further area of the valve seat, the flat deformable workpiece forming a guide section which guides the valve closing body when the valve closing body is actuated, the guide section being situated upstream from the valve seat surface;

wherein the flat deformable workpiece is bent upstream from the guide section at a bend section of the flat deformable workpiece to extend an attachment section of the flat deformable workpiece in a substantially parallel manner to a direction of a flow of a medium which flows through the valve, the attachment section being adjacent to the bend section in a direction of a circumferential end of the flat deformable workpiece.

12. The valve according to claim 11, further comprising:

a valve seat carrier having a longitudinal bore, the flat deformable workpiece being inserted into the longitudinal bore and attached to the attachment section.

13. The valve according to claim 12, wherein the flat deformable workpiece is attached to the attachment section using a welding procedure.

14. The valve according to claim 12, wherein the flat deformable workpiece is displaceable, using a displacement tool, to set a valve lift in the longitudinal bore.

15. The valve according to claim 14, wherein the displacement tool is adapted to the pot shape of the flat deformable workpiece so that the displacement tool only grips at least one of the attachment section and the bend section.

* * * * *